United States Patent [19]

Baus

[11] 4,265,839

[45] May 5, 1981

[54] EVAPORATION AIR HUMIDIFIER

[76] Inventor: Heinz G. Baus, Ulmenweg 46, CH-3601 Thun, Switzerland

[21] Appl. No.: 69,375

[22] Filed: Aug. 24, 1979

[30] Foreign Application Priority Data

Aug. 25, 1978 [DE] Fed. Rep. of Germany ..... 2837132

[51] Int. Cl.[3] ..... B01F 3/04

[52] U.S. Cl. ..... 261/91; 261/24; 261/34 R; 417/360

[58] Field of Search ..... 261/24, 28, 29, 36 R, 261/91, 34 R, 27; 417/360; 220/62, 69, 70, 76

[56] References Cited

U.S. PATENT DOCUMENTS

| | | | |
|---|---|---|---|
| 2,028,444 | 1/1936 | Feldermann | 261/91 |
| 2,413,138 | 12/1946 | Feinberg | 261/34 R |
| 3,188,007 | 6/1965 | Myklebust | 261/91 X |
| 3,304,066 | 2/1967 | Vieceli et al. | 261/91 X |
| 3,306,588 | 2/1967 | Reid | 261/91 X |
| 3,645,070 | 2/1972 | Roe | 261/91 X |
| 3,846,848 | 11/1974 | NcNair | 261/36 R |
| 3,947,152 | 3/1976 | Ross et al. | 417/360 |
| 4,057,366 | 11/1977 | Niemann | 417/360 X |
| 4,129,140 | 12/1978 | Carlin | 261/27 X |

FOREIGN PATENT DOCUMENTS

| | | | |
|---|---|---|---|
| 2059353 | 6/1971 | Fed. Rep. of Germany | 417/360 |

*Primary Examiner*—Richard L. Chiesa
*Attorney, Agent, or Firm*—Herbert L. Lerner

[57] ABSTRACT

Evaporation air humidifier having a pump, a motor for driving the pump having a shaft extending through a support plate into a water supply container, the shaft carrying a pump wheel or vanes disposed in a lower pot-shaped pump housing formed with a suction opening and a connecting piece for connecting a pressure line thereto, including a longitudinally divided support pipe surrounding the motor shaft and connecting the pump housing to the support plate, the support pipe being formed of two longitudinal shells having jointing surfaces formed with a wedge-shaped bevel at respective ends thereof extending into an opening formed in the support plate, at least one of the shells being suspended under clamping action from the support plate in vicinity of the opening formed therein, and connecting means for mechanically holding the shells and the pot-shaped pump housing together.

16 Claims, 10 Drawing Figures

EVAPORATION AIR HUMIDIFIER

BACKGROUND OF THE INVENTION

The invention relates to an evaporation air humidifier and, more particularly, to such a humidifier having a pump, a motor for driving the pump and a shaft extending through a support plate into a water supply container, the shaft carrying a pump wheel or vanes disposed in a lower pot-shaped pump housing formed with a suction opening and a connecting piece for connecting a pressure line thereto.

In a heretofore known evaporation air humidifier (German Petty Patent DE-GM No. 75 29 203), the pump together with all the additional electrical components are fastened to a plate which is bolted to an assembly plate carrying the evaporation filter and seated on the water supply container. After unlatching the aforementioned plate, the pump can, in a conventional manner, be removed from the evaporation air humidifier only together with all of the electrical components and cannot be opened without a special tool. Cleansing bacteria and calcium deposits from the pump is therefore unable to be effected by laymen.

In a further heretofore known evaporation air humidifier, the auxiliary plate carrying all of the electrical components is inserted laterally into the equipment dome and, through a partition, releasably held on the dome cover (German Petty Patent DE-GM No. 18 93 690). The pump cannot be separately removed.

SUMMARY OF THE INVENTION

It is accordingly an object of the invention to provide an evaporation air humidifier of the type described in the introduction to this specification which affords accessibility to the pump parts thereof, such as the motor shaft, the pump wheel and the pump housing, which come into contact with the water of the evaporation air humidifier, so that they may be cleaned by laymen without using a tool.

With the foregoing and other objects in view, there is provided, in accordance with the invention an evaporation air humidifier having a pump, a motor for driving the pump having a shaft extending through a support plate into a water supply container, the shaft carrying a pump wheel or vanes disposed in a lower pot-shaped pump housing formed with a suction opening and a connecting piece for connecting a pressure line thereto, including a longitudinally divided support pipe surrounding the motor shaft and connecting the pump housing to the support plate, the support pipe being formed with a wedge-shaped bevel at respective ends thereof extending into an opening formed in the support plate, at least one of the shells being suspended under clamping action from the support plate in vicinity of the opening formed therein, and connecting means for mechanically holding the shells and the pot-shaped pump housing together. A latch and/or a plug may suitably be used as the mechanical connecting means and, together with the division of the support pipe and the problem-free mounting thereof in the support plate, afford a simple and rapid removal and attachment of the pump housing. Introduction of a tool is not required.

In accordance with another feature of the invention, each shell has two flanges disposed above one another at the respective end thereof extending into the opening formed in the support plate, the flanges having a mutual spacing substantially equal to the thickness of the support plate, the wedge-shaped bevel having such an angle that, by lateral swinging of the beveled shell about an upper edge of the lower of the flanges, the upper flange is freed from the support plate. Advantageously, due to the foregoing construction, a simple clamping connection of the support pipe and the entire pump housing therewith to the support plate is permitted. The recesses permit introduction of the shells at an inclination to the plane of the plate. The shells are then turned to the normal orientation thereof perpendicular to the plane of the plate. The flanges accordingly arrive at the clamping connection thereof with the upper and lower sides of the support plate.

Each shell preferably carries a part of the cover of the pot-shaped housing so that the latter is also easy to open.

In accordance with another feature of the invention, the cover in the region of a parting line thereof has a tongue-and-groove joint.

In accordance with a further feature of the invention, the cover is formed of elastic plastic material and is formed with a bead at the periphery thereof, and the lower pot-shaped pump housing has a pot-shaped jacket formed with an annular groove in which the bead engages. The plastic material is preferably formed of soft polyvinyl chloride and permits the cover to be pressed and snapped into the seat therefor in the pot-shaped jacket.

In accordance with an added feature of the invention, the support plate is formed at the upper side thereof with a recess for receiving the upper flange of the one shell therein. With this construction, it has been advantageously found that the shells can be assembled and disassembled without being inclined. Furthermore, the mounting or connection in the support plate is more reliable because, in addition to the suspension of the one shell, a clamping of both shells against the edge of the support plate defining the opening formed therein is provided. In accordance with an additional feature of the invention and in order to achieve effective clamping, the bevels have only a slight inclination.

In accordance with yet another feature of the invention and to afford protection against twisting, the support plate is formed at the upper side thereof with a recess for receiving the upper flange of the one shell therein.

In accordance with yet a further feature of the invention, one of the shells carries half of a cover for the lower pot-shaped pump housing, half of a jacket of the lower pot-shaped housing as well as the entire bottom of the lower pot-shaped housing, and the other of the shells forming an integral component with the other half of the cover and of the jacket, the other of the shells locking with the housing bottom against lateral outward swinging.

In accordance with yet an added feature of the invention, there is included a pin disposed at the underside of the pot-shaped jacket and extending in axial direction of the support pipe, the pin engaging in a bore formed in the housing bottom.

In accordance with yet an additional feature of the invention, the other of the shells having only a lower flange having means for arresting movement thereof in vicinity of the pot-shaped pump housing for protecting the same against shifting in direction of the axis of the support tube.

In accordance with another feature of the invention, the movement arresting means are formed of a bead disposed on a free peripheral region of the housing bottom, the bead being engageable in an annular groove formed in the pot-shaped jacket.

In accordance with a further feature of the invention and to easily insert the shells into the support plate opening and to brace or support the support plate underside free of any trouble, the support pipe is cylindrical and the lower flange extends outwardly collar-like to an extent greater than the upper flange, the upper flange having a dimension in direction of the jointing surfaces equal to the outer diameter of the support pipe. When the support pipe has a rectangular cross section, the dimension is equal to the width of the support pipe.

In accordance with a concomitant feature of the invention, an upper limiting edge of the support plate defining the opening formed therein is formed with a chamfer.

Other features which are considered as characteristic for the invention are set forth in the appended claims.

Although the invention is illustrated and described herein as embodied in evaporation air humidifier, it is nevertheless not intended to be limited to the details shown, since various modifications and structural changes may be made therein without departing from the spirit of the invention and within the scope and range of equivalents of the claims.

BRIEF DESCRIPTION OF THE DRAWINGS

The construction and method of operation of the invention, however, together with additional objects and advantages thereof will be best understood from the following description of specific embodiments when read in connection with the accompanying drawings, in which.

DESCRIPTION OF THE PREFERRED EMBODIMENTS

Figure 1:
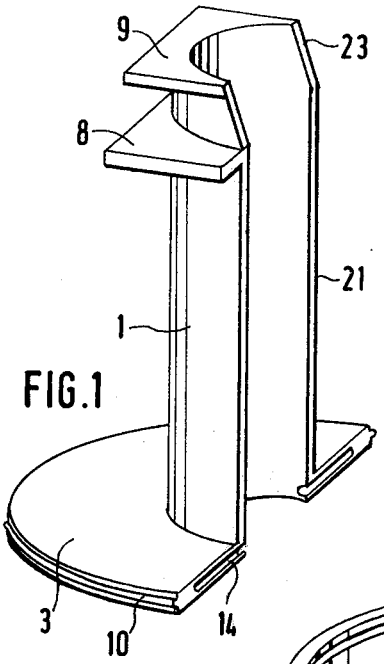
FIG. 1 is a perspective one-half view of the upper part of a pump housing of an evaporation air humidifier constructed in accordance with the invention.
Figure 2:
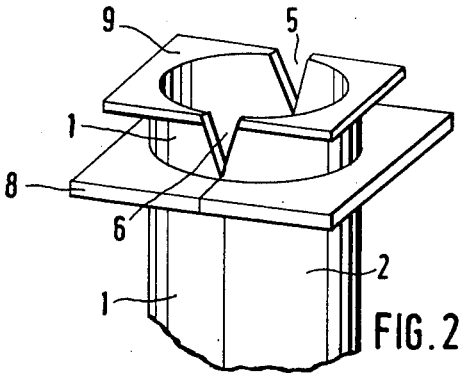
FIG. 2 is a fragmentary view of FIG. 1 showing in full the upper fastening end of a support pipe of the pump.
Figure 3:
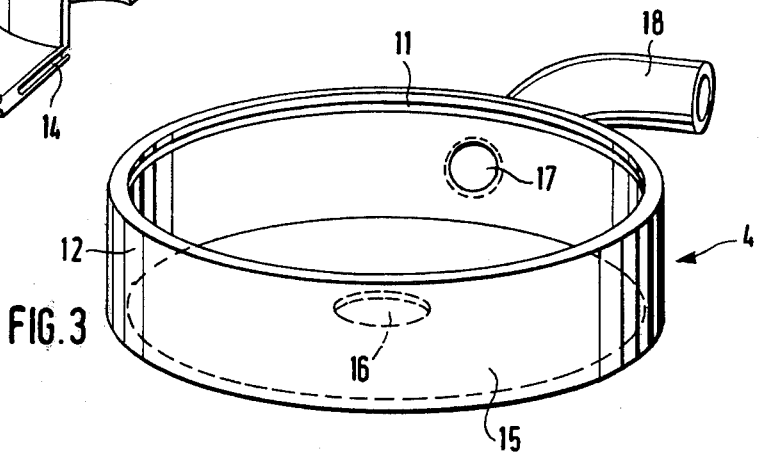
FIG. 3 is a perspective view of a lower pot-shaped part of the pump housing.

Referring now to the drawing and first, particularly to FIGS. 1 to 3 thereof, there is shown a support pipe half indicated as a shell 1. As shown in FIG. 2, the support pipe subdivided along the longitudinal axis thereof is formed of two like shells 1 and 2. Each shell 1 and 2 carries at the bottom thereof, part of a likewise halved cover 3 for a lower pot-shaped housing part 4. At the upper end of the support pipe, the parting or division surfaces 21 of the shells 1 and 2 are beveled in the form of a wedge. The bevels 23 form two diametrically opposing recesses 5 and 6, through which the plane of division or jointing plane passes, in the assembled support pipe 1, 2. Furthermore, the support pipe is formed with two flanges disposed above and mutually spaced from one another a distance corresponding to the thickness of the support plate 7 of an evaporation air humidifier. The lower flange 8 is longer or projects outwardly to a greater extent than the upper flange 9 in a direction perpendicular to the jointing or parting plane of the support pipe 1, 2. The flanges 8 and 9 are rectangular. The upper flange 9 has a width in direction of the division plane which corresponds only to the outer diameter of the support pipe 1, 2 to permit the latter to extend through the support plate 7. The upper flange 9 thus runs tangentially at the edge of the recesses 5 and 6 into the outer periphery of the support pipe 1, 2 and projects collar-like therefrom. The cover 3 is formed of plastic material and has a bead 10 at the outer rim thereof, the bead 10 being engageable in an annular groove 11 formed in a pot-like jacket 12 of the pot-shaped housing part 4. Furthermore, the cover 3 has a tongue-and-groove or slot-and-feather connection 13 (FIG. 5) in the region of the parting line thereof. In FIG. 1, for example, a groove 14 formed in the illustrated cover half 3 is apparent.

The lower pot-shaped housing part 4 has a base plate 15 integral with the pot-like jacket 12 thereof and formed with a suction opening 16 (FIG. 3). A connecting piece or nozzle 17 for connecting a pressure line 18 is provided at the pot-like jacket 12. The housing part 4 together with the support pipe 1, 2 form the pump housing.

Figure 4:
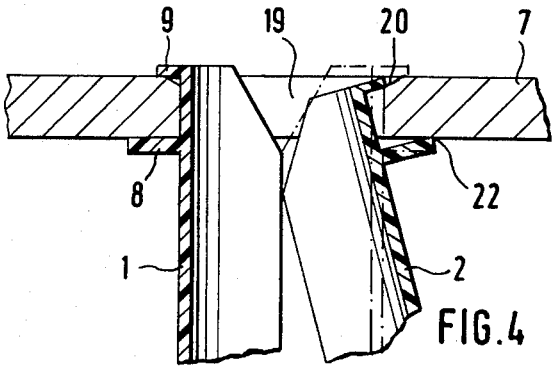
FIG. 4 is a vertical sectional view of FIG. 2 depicting the manner of fastening the support pipe to a support plate of an evaporation air humidifier.
Figure 5:
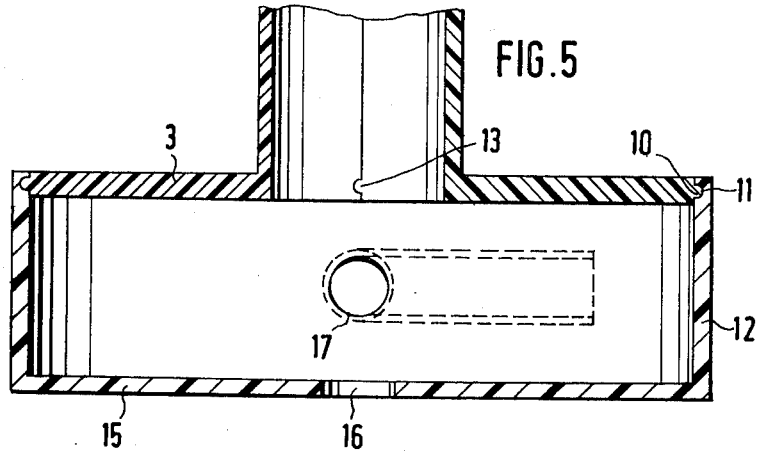
FIG. 5 is a vertical sectional view of FIG. 3 showing the lower pot-shaped housing part and the connection thereof to the support pipe.
Figure 6:
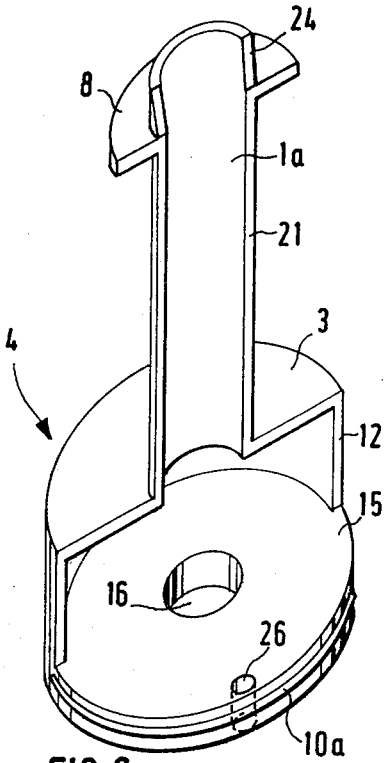
FIGS. 6 and 7 are perspective views, respectively, of the left-hand and right-hand halves of another embodiment of a pump housing of an evaporation air humidifier according to the invention.
Figure 7:
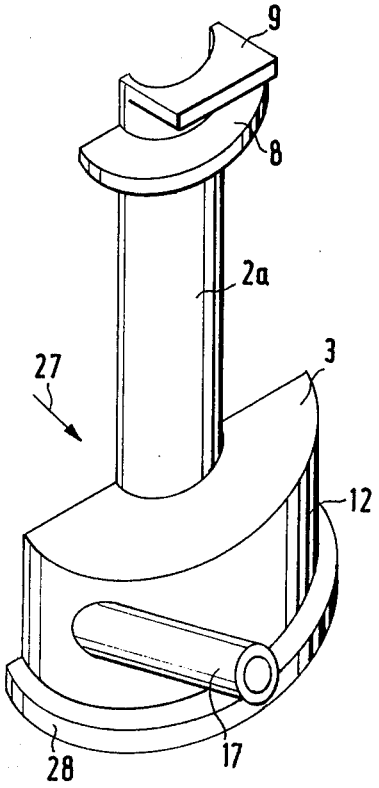

FIGS. 4 and 5 illustrate the assembly of the pump housing. The support plate 7 of the evaporation air humidifier has a rectangular or oval opening 19, the maximal width of which, with slight tolerance, corresponding to the outer diameter of the support pipe 1, 2 or, when the cross section thereof is rectangular, to the greater side length thereof. In this regard, it should be noted that the support pipe 1, 2 need not necessarily be cylindrical. A support pipe having a rectangular cross section with the hereinaforedescribed V-shaped recesses 5 and 6 as well as the flanges 8 and 9 is also suitable.

To assemble the pump housing in accordance with the invention, for example, the support pipe half 1 located at the left-hand side of FIG. 4 is inserted into the opening 19 at an inclination to the plane of the plate 7 and then turned into the phantom position thereof shown in FIG. 4. To facilitate this turning movement, the upper limiting edge of the opening 19 may be rounded off or may have a chamfer or bevel 20.

The cover 3 is pressed with the bead 10 thereof into the annular groove 11 formed in the pot-like jacket 12 (FIG. 5).

Another embodiment of the pump housing of an evaporation air humidifier is represented in FIGS. 6 to 10. As shown in the latter figures, a shell 1*a*, the cover half 3, the pot-like jacket half 12 and the entire bottom 15 of the pot-shaped housing part 4 form an integral or one-piece component. A suction opening 16 is formed in the bottom 15. A shell 2*a*, the cover half 3 and the jacket 12 having a reinforced edge or rim 28 likewise form an integral or one-piece component. A connecting piece or nozzle 17 for connecting a pressure line is mounted on the pot jacket 12. Whereas the same flange construction as for the shell 2 in FIG. 2 is provided at the upper end of the shell 2*a* in FIG. 7, only a lower flange 8 is located at the upper end of the shell 1*a* in FIG. 6. The parting or division surfaces 21 of the shells 1*a* and 2*a* is beveled or chamfered at the upper end of the respective shell halves 1*a* and 2*a*. In this regard, as is apparent from FIG. 8, the wedge-shaped bevels or chamfers 24 of the shells 1*a* and 2*a* have the same angle of inclination $\alpha$.

Figure 8:
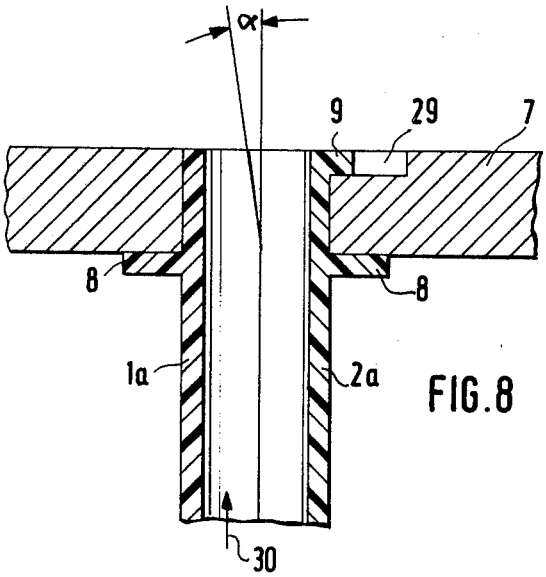
FIG. 8 is a view similar to that of FIG. 4 depicting the manner of fastening the support pipe of the embodiment of FIGS. 6 and 7 to the support plate thereof.
Figure 9:
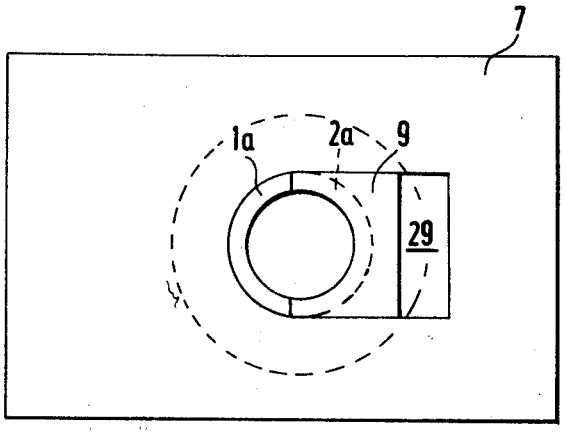
FIG. 9 is a top elevational view of FIG. 8.

To assemble the pump housing of FIGS. 6 to 10 on the support plate 7 of the evaporation air humidifier in accordance with the invention, the shell 2*a* with the flanges 8 and 9 thereof is initially slipped onto the lower and upper side of the support plate 7 as shown in FIG. 8. By the "upper side" there is meant the bearing or contact surface in a recess 29 (as shown in FIG. 8) which corresponds in width to the width of the flange and consequently serves as a protection against being loosened by turning. The shell 19 is then introduced in direction of the arrow 30 so far into the opening 19 that the lower flange 8 comes into contact with the underside of the support plate 7. The wedge-shaped bevels or chamfers 24 are so formed that when the lower flange 8 has come into contact with the support plate 7, the maximal clamping effect thereof is attained and the peripheral surfaces of the shells 1*a* and 2*a* are pressed against the edge of the opening 19.

Figure 10:
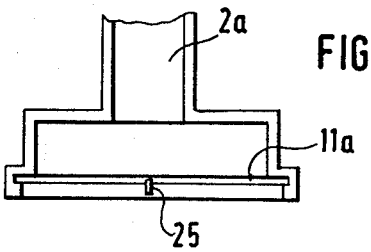
FIG. 10 is a fragmentary view of FIG. 7 taken in direction of the arrow 27.

In a concluded upward movement of the shell 1*a*, a pin 25 disposed in the bottom 15 is introduced into a bore 26 formed in the underside of the pot-like jacket 12 (FIG. 10). A laterally outward swing of the shells 1*a* and 2*a* as well as the parts of the pot-shaped housing part which are integral therewith is thereby prevented. By means of a bead 10*a* provided on the free peripheral region of the bottom 15 and engaging in an annular groove 11*a* formed in the pot jacket 12, the shell 1*a* is protected against being shifted in direction of the axis thereof. It may be sufficient, respectively, to provide short beads 10*a* opposite and near to the plane of division or jointing plane.

It should also be noted that the shape of both shells 1, 1*a* and 2, 2*a* with the cover or jacket halves integral therewith is also very advantageous from the standpoint of production engineering or technology.

The clamping connection of the shells 1, 1*a* and 2, 2*a* with the support plate 7 is exceptionally stable mechanically and, nevertheless, relatively easy to release or loosen.

The shape of the flanges 8 and 9 of the shells 1, 1*a* and 2, 2*a* need not be exactly symmetrical. More space is available for the shell 1 or 2 initially fed through the opening 19 than for the shell which is introduced last, so that the lower flange 8 of the first shell can project collar-like all around farther than for the last introduced shell.

There are claimed:

1. Evaporation air humidifier having a pump, a motor for driving the pump having a shaft extending through a support plate into a water supply container, the shaft carrying a pump wheel or vanes disposed in a lower pot-shaped pump housing formed with a suction opening and a connecting piece for connecting a pressure line thereto, comprising a longitudinally divided support pipe surrounding the motor shaft and connecting the pump housing to the support plate, said support pipe being formed of two longitudinal shells having jointing surfaces formed with a wedge-shaped bevel at respective ends thereof extending into an opening formed in the support plate, at least one of said shells being suspended under clamping action from the support plate in vicinity of said opening formed therein, and connecting means for mechanically holding said shells and said pot-shaped pump housing together.

2. Evaporation air humidifier according to claim 1 wherein each shell has two flanges disposed above one another at the respective end thereof extending into said opening formed in the support plate, said flanges having a mutual spacing substantially equal to the thickness of the support plate, said wedge-shaped bevel having such an angle that, by lateral swinging of said beveled shell about an upper edge of the lower of said flanges, the upper flange is freed from the support plate.

3. Evaporation air humidifier according to claim 1 wherein the bevels at the respective ends of said shells define a V-shaped recess.

4. Evaporation air humidifier according to claim 1 wherein each shell carries part of a cover for the lower pot-shaped pump housing.

5. Evaporation air humidifier according to claim 4 wherein said cover in the region of a parting line thereof has a tongue-and-groove joint.

6. Evaporation air humidifier according to claim 4 wherein said cover is formed of elastic plastic material and is formed with a bead at the periphery thereof, and the lower pot-shaped pump housing has a pot-shaped jacket formed with an annular groove in which said bead engages.

7. Evaporation air humidifier according to claim 1 wherein one of said shells has two flanges disposed above one another at the respective end thereof extending into said opening formed in the support plate, said flanges having a mutual spacing substantially equal to the thickness of the support plate, said other of said shells having only a lower flange, and said wedge-shaped bevels being formed so that, in installed condition, said support pipe is firmly clamped against an edge thereof defining said opening formed therein.

8. Evaporation air humidifier according to claim 7 wherein said wedge-shaped bevels are formed with a slight inclination.

9. Evaporation air humidifier according to claim 7 wherein the support plate is formed at the upper side thereof with a recess for receiving the upper flange of said one shell therein.

10. Evaporation air humidifier according to claim 2 or 7 wherein said support pipe is cylindrical, and the lower flange extends outwardly collar-like to an extent greater than the upper flange, said upper flange having a dimension in direction of said jointing surfaces equal to the outer diameter of said support pipe.

11. Evaporation air humidifier according to claim 2 or 7 wherein said support pipe has a rectangular cross section, and the lower flange extends outwardly collar-like to an extent greater than the upper flange, said upper flange having a dimension in direction of said jointing surfaces equal to the width of said support pipe.

12. Evaporation air humidifier according to claim 2 or 7 wherein an upper limiting edge of the support plate defining said opening formed therein is formed with a chamfer.

13. Evaporation air humidifier according to claim 7 wherein said other of said shells having only a lower flange having means for arresting movement thereof in vicinity of said pot-shaped pump housing for protecting the same against shifting in direction of the axis of said support tube.

14. Evaporation air humidifier according to claim 13 wherein said movement arresting means are formed of a bead disposed on a free peripheral region of said housing bottom, said bead being engageable in an annular groove formed in said pot-shaped jacket.

15. Evaporation air humidifier according to claim 1 wherein one of said shells carries half of a cover for the lower pot-shaped pump housing, half of a jacket of the lower pot-shaped housing as well as the entire bottom of the lower pot-shaped housing, and the other of said shells forming an integral component with the other half of said cover and of said jacket, said other of said shells locking with said housing bottom against lateral outward swinging.

16. Evaporation air humidifier according to claim 15 including a pin disposed at the underside of said pot-shaped jacket and extending in axial direction of said support pipe, said pin engaging in a bore formed in said housing bottom.

* * * * *